US006568046B1

(12) United States Patent
Savicki et al.

(10) Patent No.: US 6,568,046 B1
(45) Date of Patent: May 27, 2003

(54) CLOSURE DEVICE

(75) Inventors: Alan F. Savicki, Oswego, IL (US); Ronald J. Cisek, Hinsdale, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 10/049,535

(22) PCT Filed: Jun. 6, 2000

(86) PCT No.: PCT/US00/40123

§ 371 (c)(1),
(2), (4) Date: Feb. 5, 2002

(87) PCT Pub. No.: WO01/93716

PCT Pub. Date: Dec. 13, 2001

(51) Int. Cl.[7] ..... A44B 19/16; B65D 33/16; B65D 33/24

(52) U.S. Cl. ..... 24/387; 24/399; 24/415; 24/427; 24/389; 24/435; 24/585.12; 383/63; 383/64

(58) Field of Search ..... 24/387, 399, 400, 24/427, 587, 415, 389, 435, 585.12, 394, 572.1; 383/63, 64, 65

(56) References Cited

U.S. PATENT DOCUMENTS

| | | | | |
|---|---|---|---|---|
| 2,975,496 A | | 3/1961 | McGraw | |
| 3,173,184 A | | 3/1965 | Ausnit | |
| 5,007,143 A | | 4/1991 | Herrington | |
| 5,020,194 A | | 6/1991 | Herrington et al. | |
| 5,070,583 A | | 12/1991 | Herrington | |
| 5,442,837 A | | 8/1995 | Morgan | |
| 5,442,838 A | | 8/1995 | Richardson et al. | |
| 5,664,299 A | | 9/1997 | Porchia et al. | |
| 5,809,621 A | | 9/1998 | McCree et al. | |
| 5,871,281 A | * | 2/1999 | Stolmeier et al. | 383/64 |
| 5,924,173 A | | 7/1999 | Dobreski et al. | |
| 5,950,285 A | | 9/1999 | Porchia et al. | |
| 6,047,450 A | | 4/2000 | Machacek et al. | |

* cited by examiner

*Primary Examiner*—Victor Sakran
(74) *Attorney, Agent, or Firm*—Thomas C. Feix

(57) ABSTRACT

The closure device includes interlocking fastening strips and a slider. The ends of the fastening strips are heat sealed, melted or otherwise secured together. The fastening strips include a slit near the end of the fastening strips. The slit prevents the separator of the slider from deoccluding the fastening strips when the slider is at the occluded end. The slit allows the top edge of the fastening strips to bend around the separator while the fastening strips remain occluded.

48 Claims, 10 Drawing Sheets

CLOSURE DEVICE

FIELD OF THE INVENTION

The present invention relates generally to closure devices and, more particularly, to a slider and interlocking fastening strips utilizing a slit. The invention is particularly well suited for fastening flexible storage containers, including plastic bags.

BACKGROUND OF THE INVENTION

The use of closure devices for fastening storage containers, including plastic bags, is generally known. Furthermore, the manufacture of closure devices made of plastic materials is generally known to those skilled in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the sidewalls of the container are integrally formed by extrusion as a single piece. Alternatively, the closure device and sidewalls of the container may be formed as separate pieces and then connected by heat sealing or any other suitable connecting process. In either event, such closure devices are particularly useful in providing a closure means for retaining matter within the bag.

Closure devices typically utilize mating fastening strips or closure elements, which are used to selectively seal the bag. In addition, sliders may be provided for use in opening and closing the fastening strips. The sliders may include a separator which extends at least partially between the fastening strips. When the slider is moved in the appropriate direction, the separator divides the fastening strips and opens the bag.

SUMMARY OF THE INVENTION

The closure device comprises first and second interlocking fastening strips arranged to be interlocked over a predetermined length. The closure device includes a slider, slidably disposed on the interlocking fastening strips for facilitating the occlusion and deocclusion of the fastening strips when moved towards first and second ends of the fastening strips. Slits are placed near the first end of the fastening strips. The slits facilitate the occlusion of the container by preventing the slider from deoccluding the fastening strips when the slider is at the first end.

DESCRIPTION OF THE EMBODIMENTS

Figure 1:
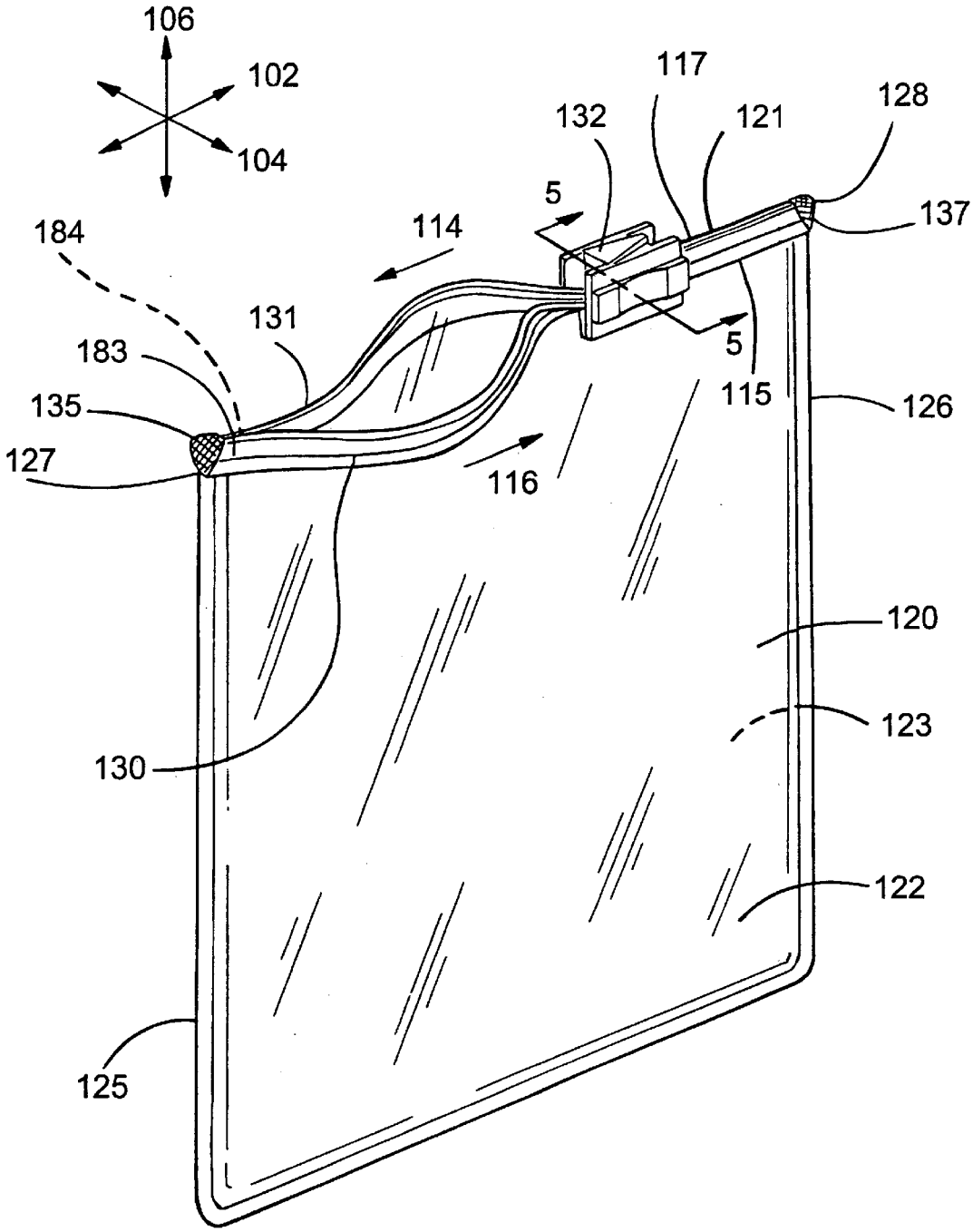
FIG. 1 is a perspective view of a container according to the present invention in the form of a plastic bag.
Figure 2:
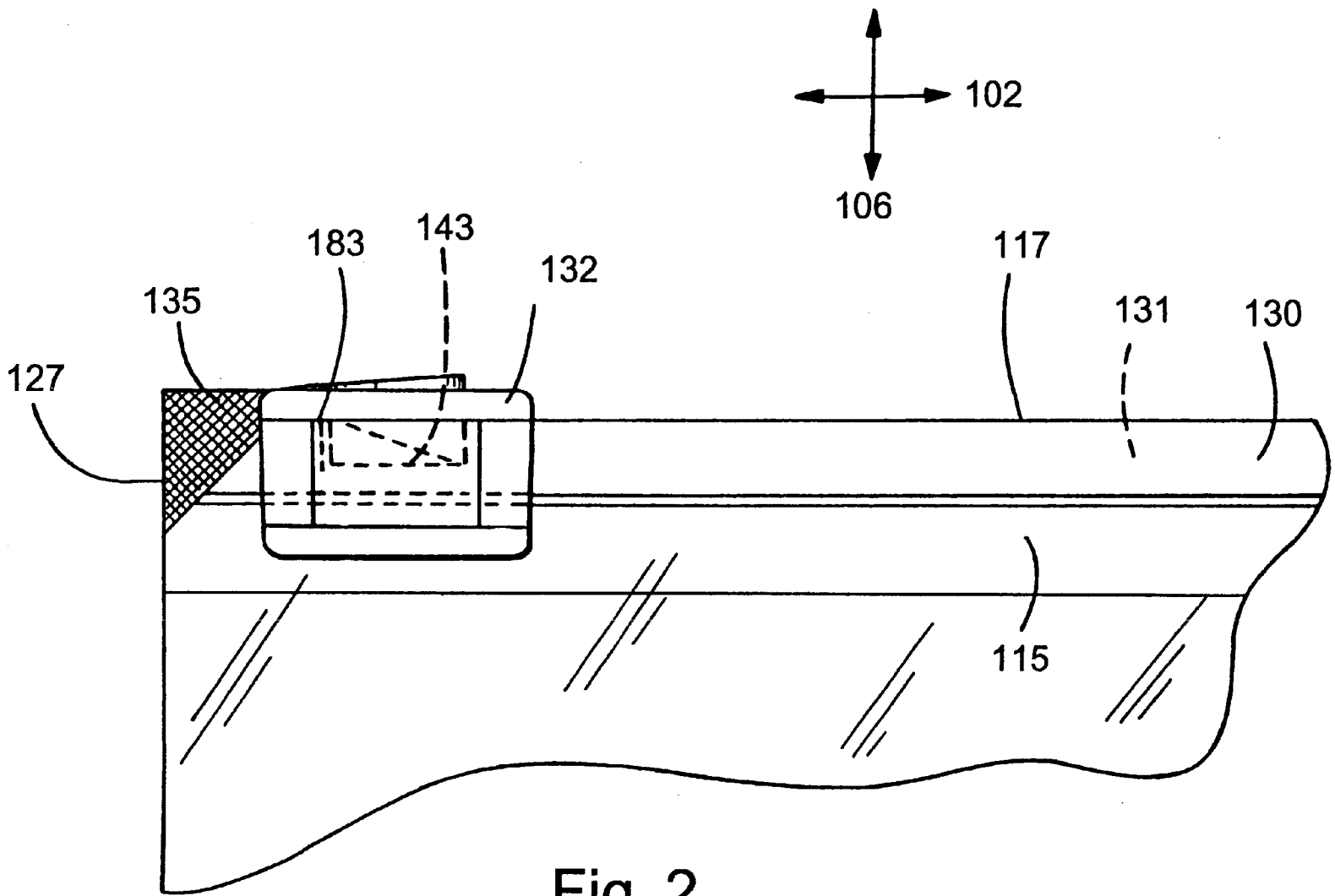
FIG. 2 is a fragmentary side view of the container in FIG. 1.

FIGS. 1–5 illustrate an embodiment of a container in the form of a plastic bag 120 having a sealable closure device 121. The bag 120 includes a first sidewall 122 and a second sidewall 123 joined at seams 125, 126 to define a compartment accessible through the open top end but sealable by means of the closure device 121. The closure device 121 includes first and second fastening strips 130, 131 and a slider 132.

The fastening strips 130, 131 and the slider 132 have a longitudinal X axis 102, a transverse Y axis 104 and a vertical Z axis 106. The transverse Y axis 104 is perpendicular to the longitudinal X axis 102. The vertical Z axis 106 is perpendicular to the longitudinal X axis 102 and the vertical Z axis 106 is perpendicular to the transverse Y axis 104. The fastening strips 130, 131 have a bottom edge 115 and a top edge 117.

The fastening strips 130, 131 are adapted to be interlocked between a first end 127 and a second end 128. The fastening strips 130, 131 are secured together at the first and second ends 127, 128 to form end seals. As shown in the figures, the first and second ends 127, 128 include melted portions 135, 137, in which the fastening strips 130, 131 are melted together by heat sealing, ultrasonic sealing or other operation to form the end seals. In other embodiments, the first and second ends 127, 128 may be secured together by plastic clamps, or other means.

The first fastening strip 130 includes a first slit 183 placed in close proximity to the first end 127 and placed before the melted portion 135. The second fastening strip 131 may include a second slit 184 near the first end 127. The first slit 183 may be used alone or in combination with the second slit 184. The slits 183, 184 extend downward in the vertical Z axis 106 beginning at the top edge 117 and extend to a point which is between the bottom and top edges 115, 117. In this embodiment, the slits 183, 184 are at 90° to the X axis 102.

Figure 6:
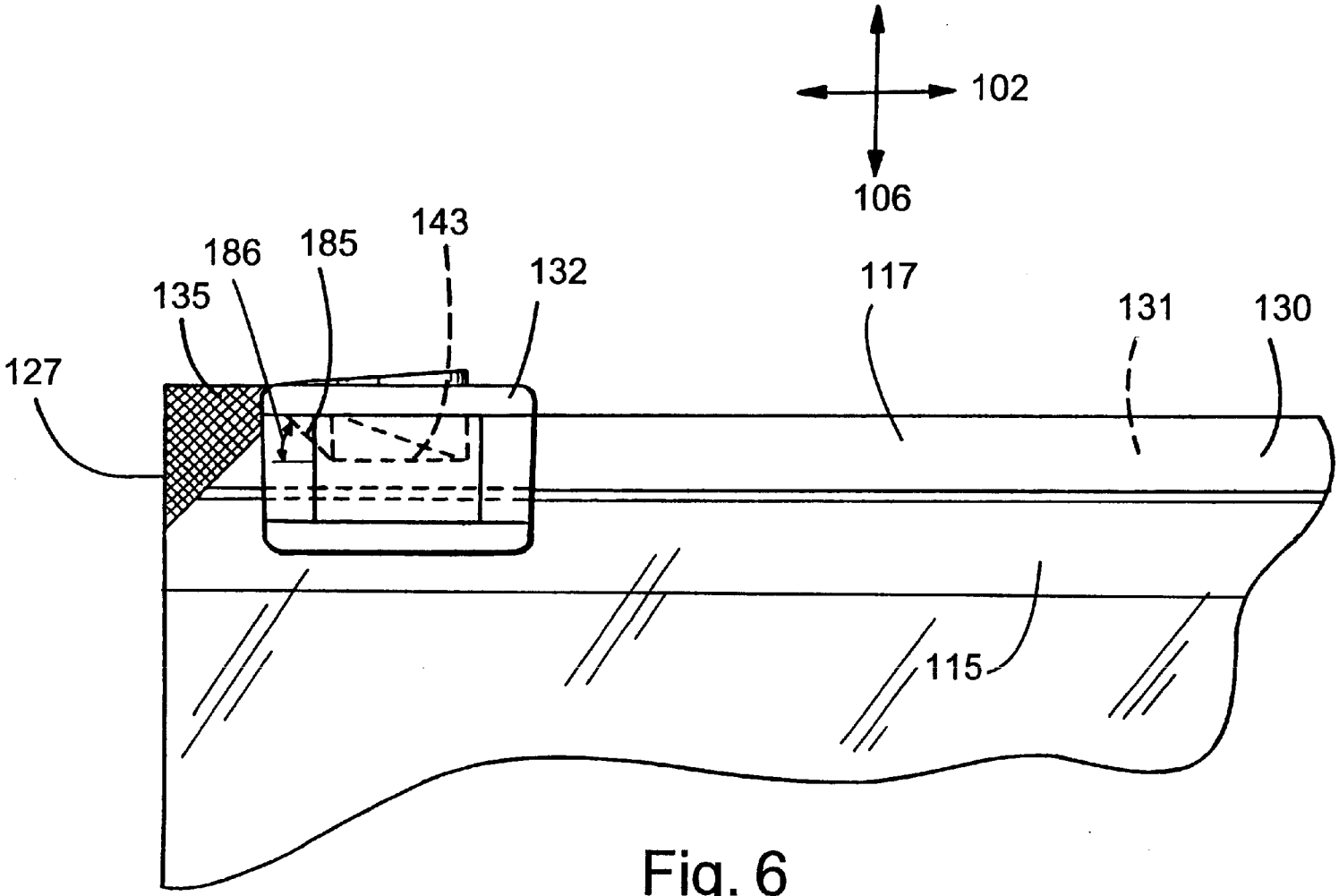
FIG. 6 is a fragmentary side view of another embodiment.

In another embodiment shown in FIG. 6, the slit 185 may be placed at an angle 186 relative to the X axis 102. The angle 186 may range from 1° to 179° from the X axis 102. A more preferred range is from 45° to 135°. The slit 185 may be used alone or in combination with other slits at the same or different angles.

The slider 132 is mounted onto the fastening strips 130, 131 so that the slider 132 is restrained from being removed from the fastening strips 130, 131 in the Z axis 106, but free to slide along the X axis 102. The slider 132 engages the fastening strips 130, 131 so that when the slider 132 moves in an occlusion direction 114, the fastening strips 130, 131 interlock and the bag 120 is sealed, and when the slider 132 moves in a deocclusion direction 116, the fastening strips 130, 131 separate and the bag 120 is open.

Figure 5:
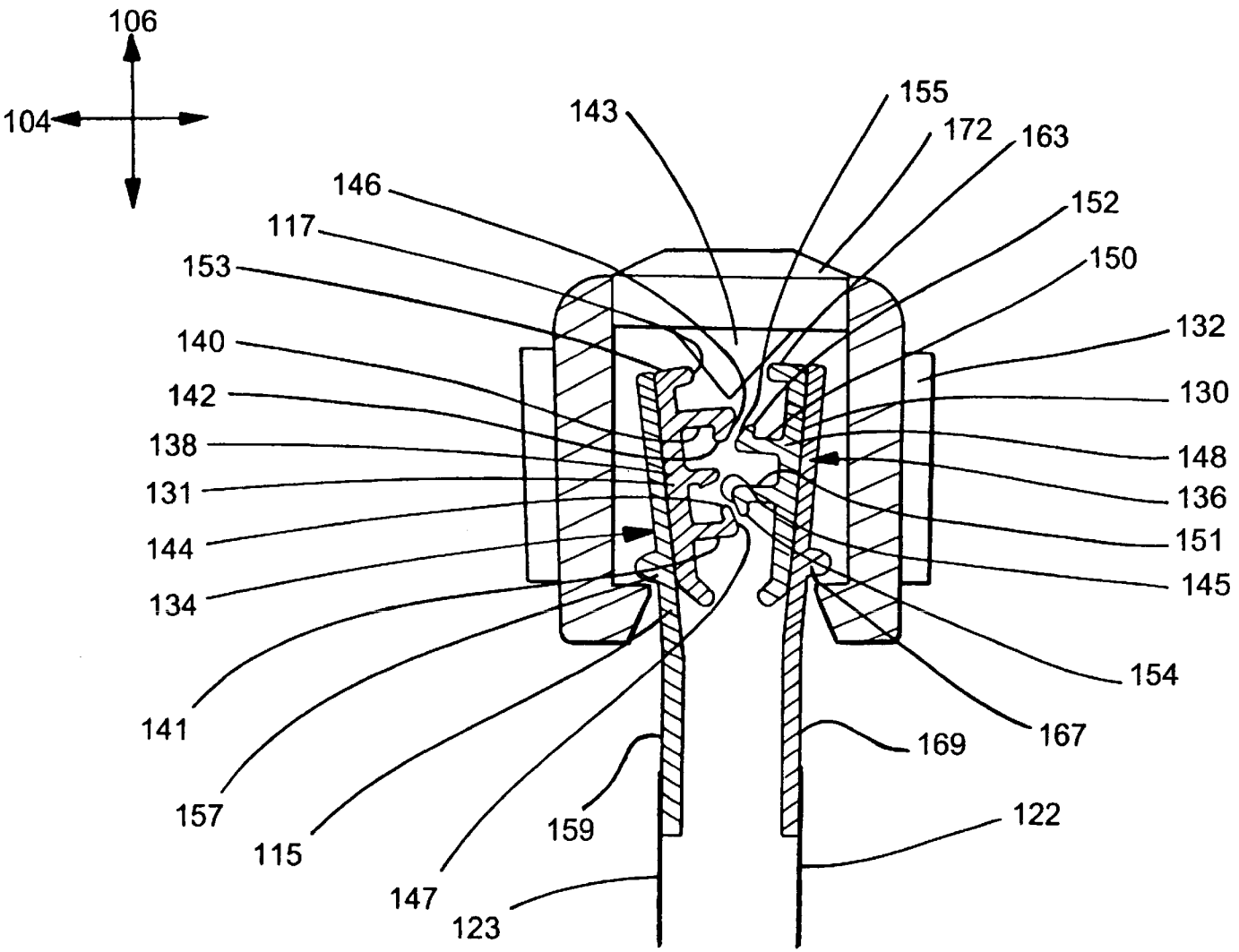
FIG. 5 is a cross-sectional view taken along line 5—5 in FIG. 1.

Referring to FIG. 5, the fastening strips include a first fastening strip 130 with a first closure element 136 and a second fastening strip 131 with a second closure element 134. The first closure element 136 engages the second closure element 134. The first fastening strip 130 may include a flange 163 disposed at the upper end of the first fastening strip 130 and a rib 167 disposed at the lower end of the first fastening strip 130. The first fastening strip 130 may also include tape portion 169. Likewise, the second fastening strip 131 may include a flange 153 disposed at the upper end of the second fastening strip 131 and a rib 157 disposed at the lower end of the second fastening strip 131. The second fastening strip 131 may also include tape portion 159. The side walls 122, 123 of the plastic bag 120 may be attached to the fastening strips 130, 131 by conventional manufacturing techniques.

The second closure element 134 includes a base portion 138 having a pair of spaced-apart parallely disposed webs 140, 141, extending from the base portion 138. The base and the webs form a U-channel closure element. The webs 140, 141 include hook closure portions 142, 144 extending from the webs 140, 141 respectively, and facing towards each other. The hook closure portions 142, 144 include guide surfaces 146, 147 which serve to guide the hook closure portions 142, 144 for occluding with the hook closure portions 152, 154 of the first closure element 136.

The first closure element 136 includes a base portion 148 including a pair of spaced-apart, parallely disposed webs 150, 151 extending from the base portion 148. The base and the webs form a U-channel closure element. The webs 150, 151 include hook closure portions 152, 154 extending from the webs 150, 151 respectively and facing away from each other. The hook closure portions 152, 154 include guide surfaces 145, 155, which generally serve to guide the hook closure portions 152, 154 for occlusion with the hook closure portions 142, 144 of the second closure element 134. The guide surfaces 145, 155 may also have a rounded crown surface.

The slider 132 includes a top portion 172. The top portion provides a separator 143 having a first end and a second end wherein the first end may be wider than the second end. In addition, the separator 143 may be triangular in shape. When the slider is moved in the occlusion direction, the separator 143 deoccludes the fastening strips 130, 131 as shown in FIG. 5. Referring to FIG. 5, the closure elements 134, 136 are deoccluded and specifically, the upper hook portions 142, 152 and the lower hook portions 144, 154 are deoccluded.

Figure 4:
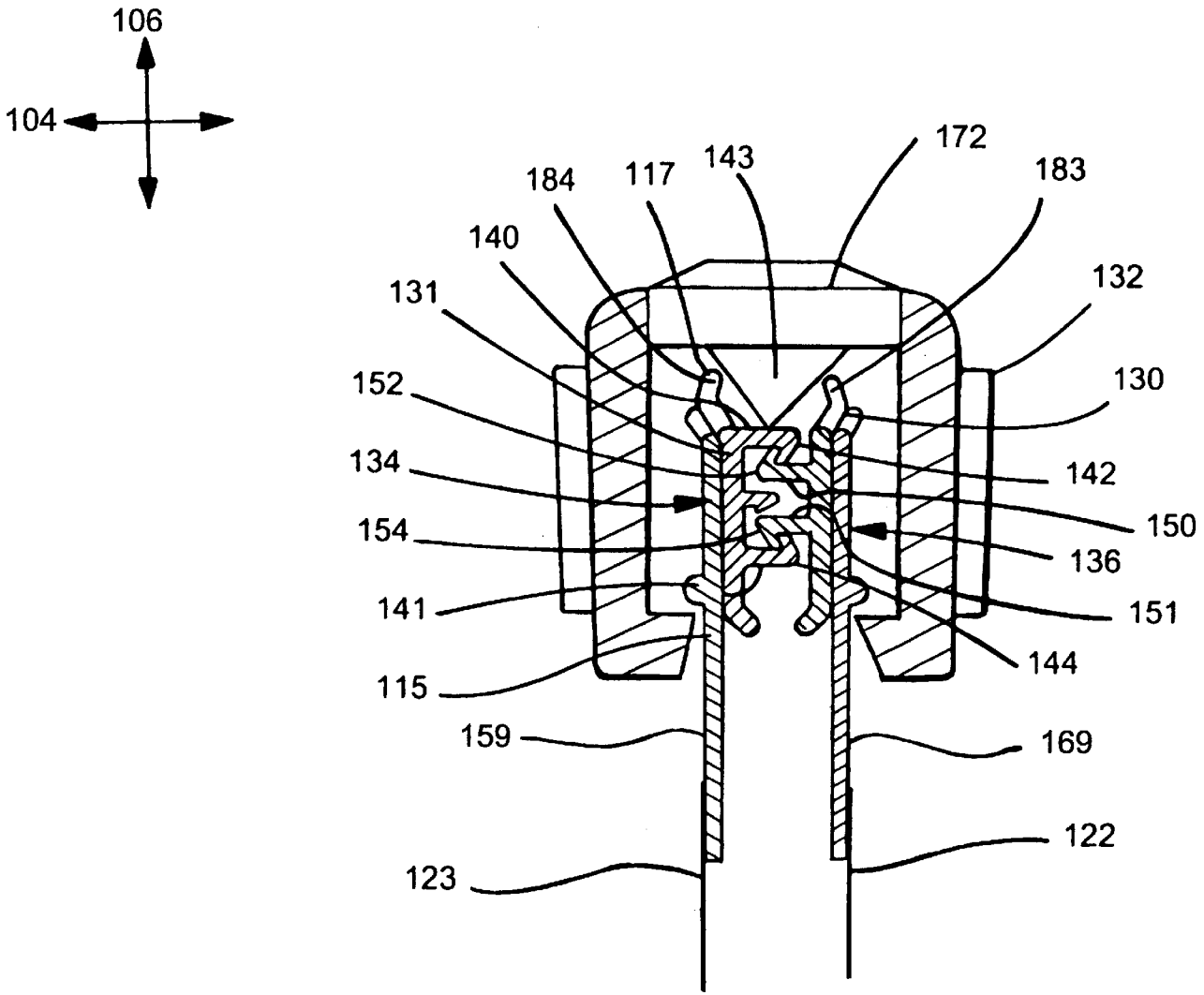
FIG. 4 is a cross-sectional view taken along line 4—4 in FIG. 3.

As shown in FIG. 4, the slits 183, 184 extend downward in the vertical Z axis 106 beginning at the top edge 117 and end before the closure elements 134, 136. In this embodiment, the slits 183, 184 end before the webs 140, 150. In another embodiment, the slits may end below the webs 140, 150 but above the webs 141, 151.

In accordance with the present invention, the slit 183 is provided in close proximity to the first end 127 for facilitating the closure of the fastening strips at the first end 127 as shown in FIG. 4. The slit 183 allows the top edge 117 of fastening strips 130, 131 to separate while preventing the bottom edge 115 from separating. The closure elements 134, 136 remain occluded when the slider is at a first end 127. Specifically, the upper hook portions 142, 152 and the lower hook portions 144, 154 remain occluded when the slider is at the first end 127. The slit 183 forms a discontinuity in the fastening strips 130, 131, which prevents the separator 143 from deoccluding the closure elements 134, 136 on the fastening strips. The separator 143 causes the top edge 117 of the fastening strips 130, 131 to move away from each other. However, the fastening strips 130, 131 remain occluded because the slit 183 allows the separator 143 to move the top edges 117 away from each other without separating the closure elements 134, 136 on the fastening strips.

Figure 3:
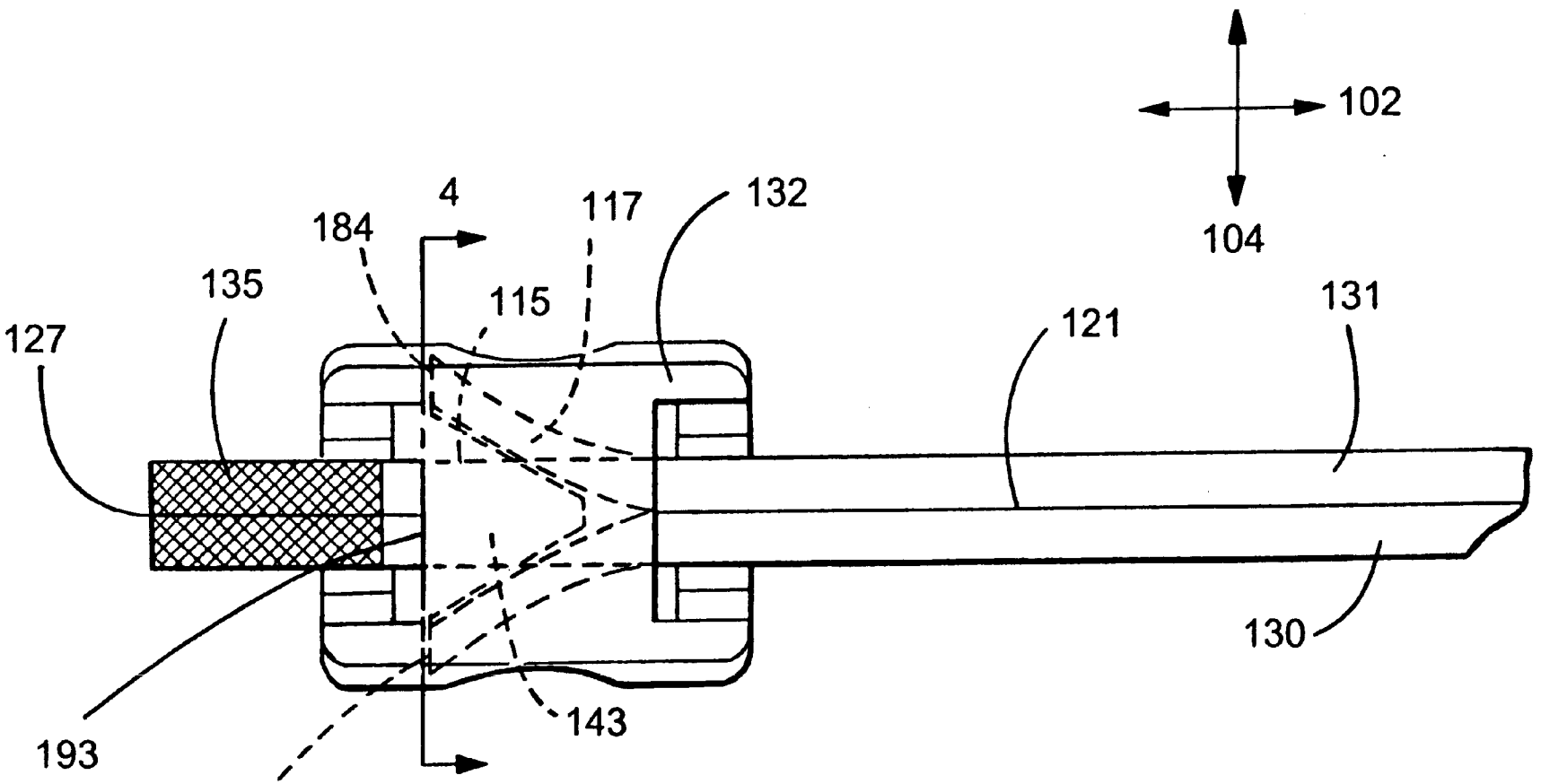
FIG. 3 is a fragmentary top view of the container in FIG. 2.

As shown in FIG. 3, the slit 183 also provides an end stop for the slider. The separator 143 is allowed to move in the occlusion direction as far as the slit 183 and not further. Specifically, the separator 143 engages the portion 193 of the fastening strip which is to the left of the slit 183 as shown in FIG. 3. The portion 193 prevents the separator 143 from moving in the occlusion direction. The portion 193 blocks the path of the separator 143 and the separator 143 cannot separate the closure elements due to the slit 183.

Figure 7:
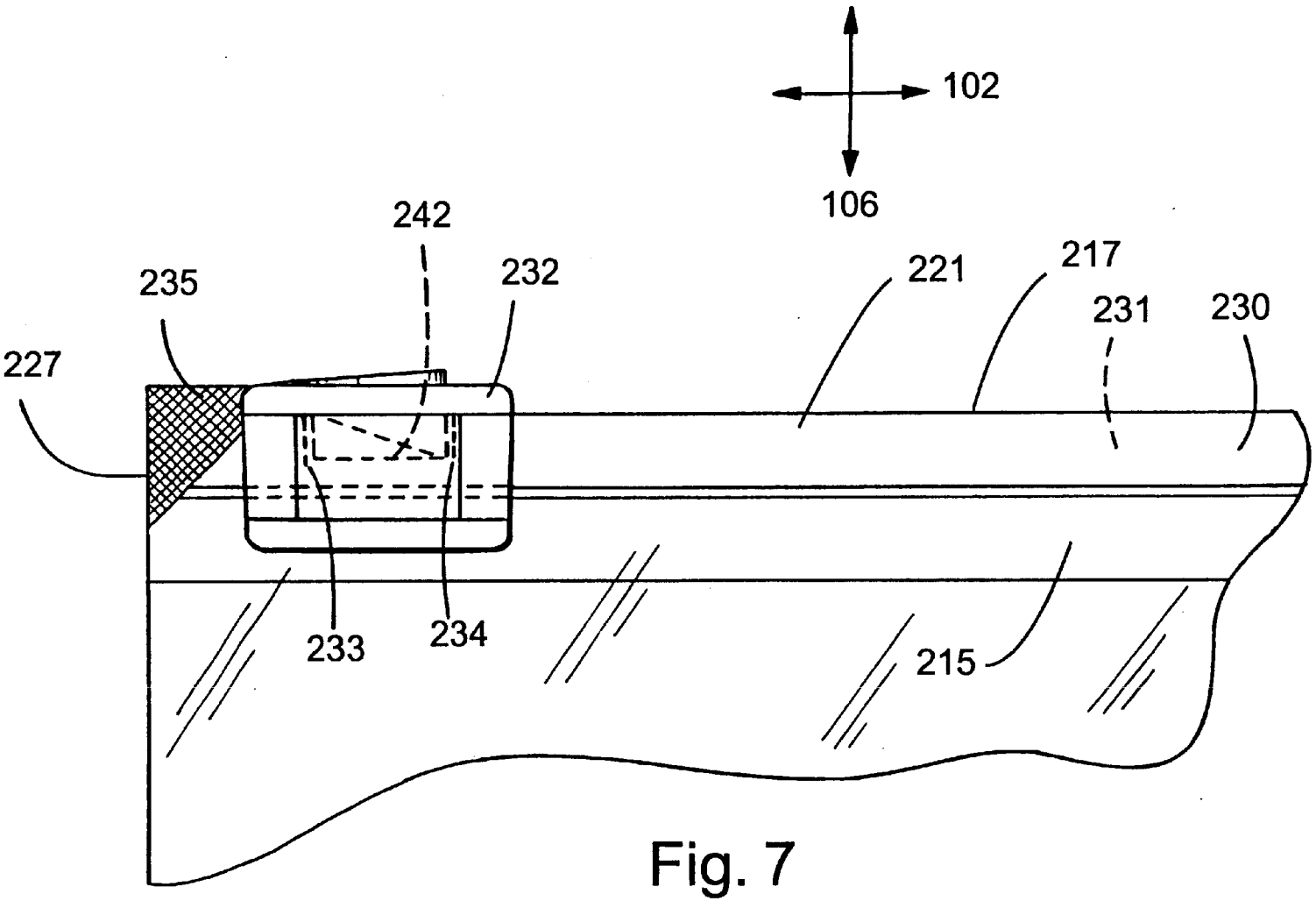
FIG. 7 is a fragmentary side view of another embodiment.
Figure 8:
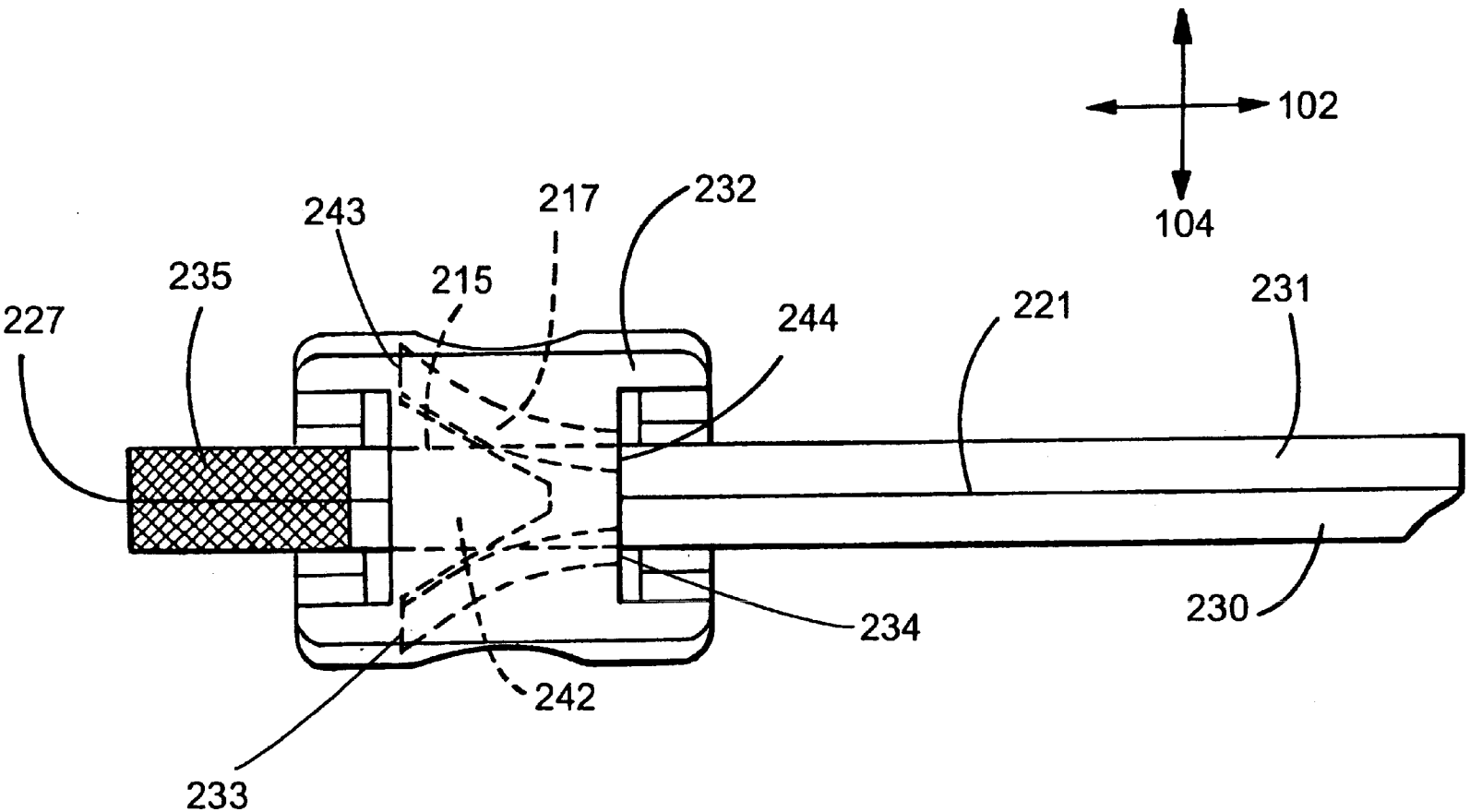
FIG. 8 is a fragmentary top view of the container in FIG. 7.

FIGS. 7 and 8 show a fragmentary side view of another embodiment of the closure device 221. The closure device 221 includes a first fastening strip 230, a second fastening strip 231 and a slider 232. The first fastening strip 230 may include a slit 233 and a second slit 234. The second fastening strip 231 may include a third slit 243 and a fourth slit 244. The slits 233, 234, 243, 244 start at the top edge 217 of the fastening strips 230, 231 and proceed to a point partway between the bottom and top edges 215, 217. In this embodiment, the slits begin at the top edge and end at a location above the closure elements. The slits 233, 234, 243, 244 may be placed near the first end 227 near the melted portion 235. When placed on both sides of the separator 242, the slits 233, 234, 243, 244 further facilitate the occlusion of the fastening strips 230, 231 by preventing the separator 242 from deoccluding the fastening strips 230, 231 as described above.

Figure 9:
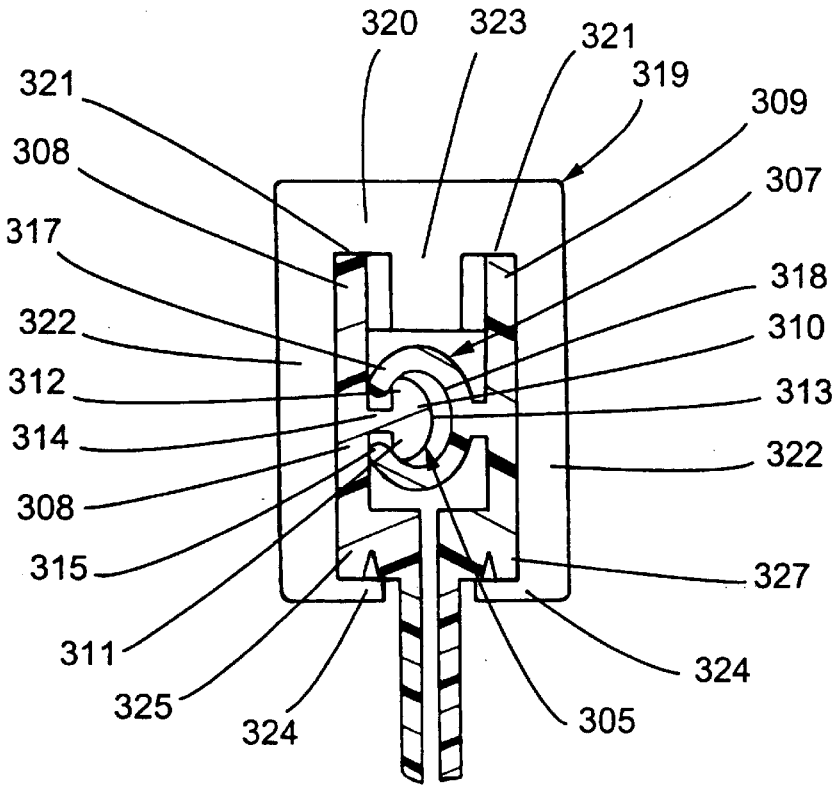
FIG. 9 is a cross-sectional view of another embodiment.
Figure 10:
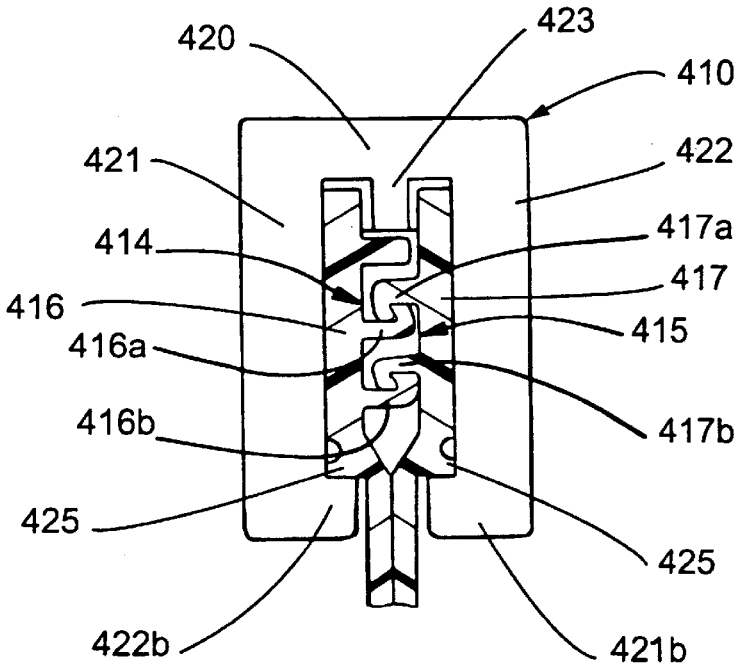
FIG. 10 is a cross-sectional view of another embodiment.
Figure 11:
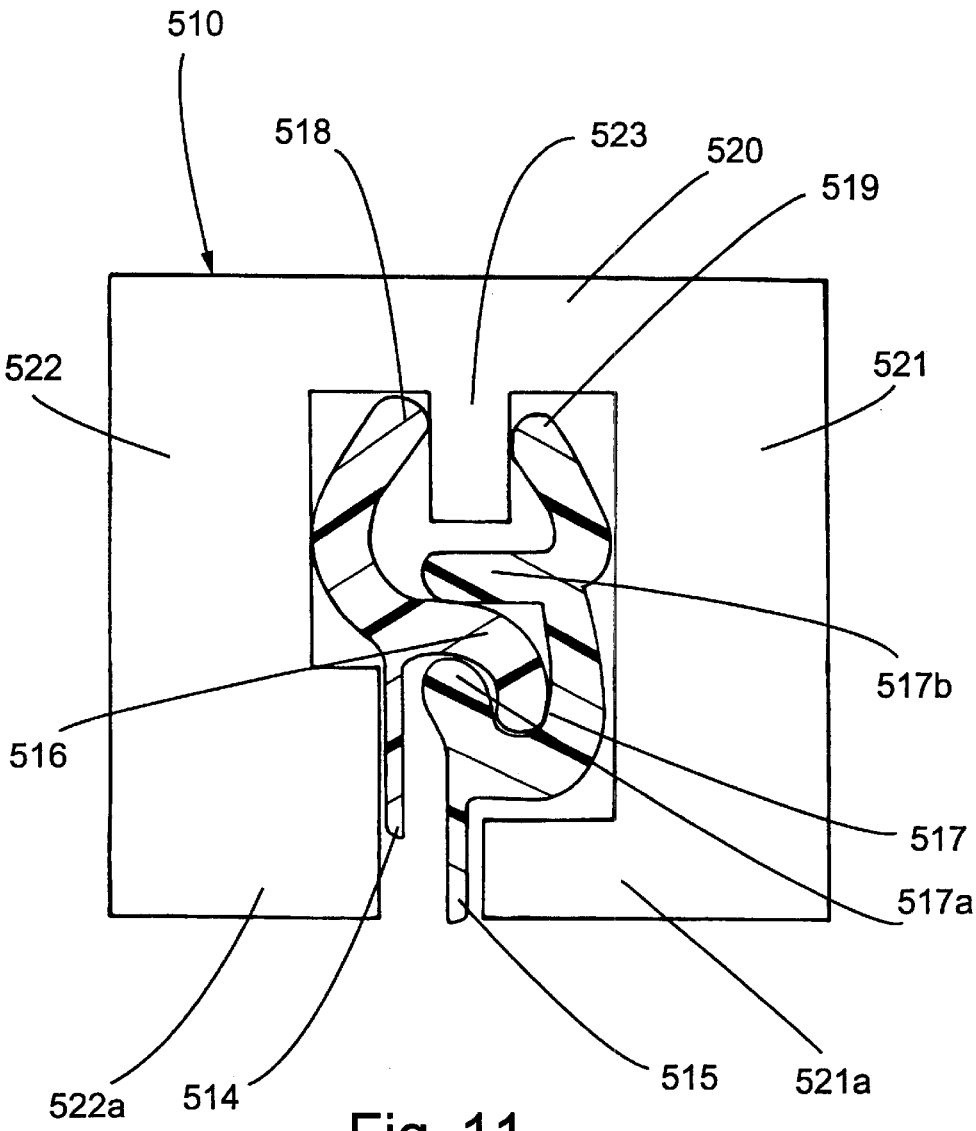
FIG. 11 is a cross-sectional view of another embodiment.

The slit or slits may be used on fastening strips with different closure elements. FIGS. 9–11 illustrate interlocking fastening strips of different configurations with a slider.

The interlocking fastening strips may comprise "arrowhead-type" or "rib and groove" fastening strips as shown in FIG. 9 and as described in U.S. Pat. No. 3,806,998. The rib element 305 interlocks with the groove element 307. The rib element 305 is of generally arrow-shape in transverse cross section including a head 310 comprising interlock shoulder hook portions 311 and 312 generally convergently related to provide a cam ridge 313 generally aligned with a stem flange 314 by which the head is connected in spaced relation with respect to the supporting flange portion 308. (U.S. Pat. No. 3,806,998, Col. 2, lines 16–23). At their surfaces nearest the connecting stem flange 314, the shoulder portions 311 and 312 define reentrant angles therewith providing interlock hooks engageable with interlock hook flanges 315 and 317 respectively of the groove element 307. (U.S. Pat. No. 3,806,998, Col. 2, lines 23–28). Said hook flanges generally converge toward one another and are spread open to receive the head 310 therebetween when said head is pressed into said groove element 307 until the head is fully received in a groove 318 of said groove element 307 generally complementary to the head and within which the head is interlocked by interengagement of the head shoulder hook portions 311 and 312 and the groove hook flanges 315 and 317. (U.S. Pat. No. 3,806,998, Col. 2, lines 28–36). Through this arrangement, as indicated, the head and groove elements 305 and 307 are adapted to be interlockingly engaged by being pressed together and to be separated when forcably pulled apart, as by means of a generally U-shaped slider 319. (U.S. Pat. No. 3,806,998, Col. 2, lines 36–41).

The slider 319 includes a flat back plate 320 adapted to run along free edges 321 on the upper ends of the sections of the flange portions 308 and 309 as shown in the drawing. (U.S. Pat. No. 3,806,998, Col. 2, lines 41–46). Integrally formed with the back plate 320 and extending in the same direction (downwardly as shown) therefrom are respective coextensive side walls 322 with an intermediate spreader finger 323 extending in the same direction as the side walls at one end of the slider. (U.S. Pat. No. 3,806,998, Col. 2, lines 46–51). The side walls 322 are in the form of panels which are laterally divergent from a narrower end of the slider. (U.S. Pat. No. 3,806,998, Col. 2, lines 51–55). The slider walls 322 are each provided with an inwardly projecting shoulder structure 324 flange adapted to engage respective shoulder ribs 325 and 327 on respectively outer sides of the lower section of the flange portions 308 and 309. (U.S. Pat. No. 3,806,998, Col. 2, line 66 to Co. 3, line 3).

Additionally, the interlocking fastening strips may comprise "profile" fastening strips, as shown in FIG. 10 and described in U.S. Pat. No. 5,664,299. As shown in FIG. 10, the first profile 416 has at least an uppermost closure element 416*a* and a bottommost closure element 416*b*. (U.S. Pat. No. 5,664,299, Col. 3, lines 25–27). The closure elements 416*a* and 416*b* project laterally from the inner surface of strip 414. (U.S. Pat. No. 5,664,299, Col. 3, lines 27–28). Likewise, the second profile 417 has at least an uppermost closure element 417*a* and a bottommost closure element 417*b*. (U.S. Pat. No. 5,664,299, Col. 3, lines 28–30). The closure elements 417*a* and 417*b* project laterally from the inner surface of strip 415. (U.S. Pat. No. 5,664,299, Col. 3, lines 30–32). When the bag is closed, the closure elements of profile 416 interlock with the corresponding closure elements of profile 417. (U.S. Pat. No. 5,664,299, Col. 3, lines 32–34). As shown in FIG. 10, closure elements 416*a*, 416*b*, 417*a* and 417*b* have hooks on the ends of the closure elements, so that the profiles remain interlocked when the bag is closed, thereby forming a seal. (U.S. Pat. No. 5,664,299, Col. 3, lines 34–37).

The straddling slider 410 comprises an inverted U-shaped member having a top 420 for moving along the top edges of the strips 414 and 415. (U.S. Pat. No. 5,664,299, Col. 4, lines 1–3). The slider 410 has side walls 421 and 422 depending from the top 420. (U.S. Pat. No. 5,664,299, Col. 4, lines 3–4). A separating leg 423 depends from the top 420 between the side walls 421 and 422 and is located between the uppermost closure elements 416*a* and 417*a* of profiles 416 and 417. (U.S. Pat. No. 5,664,299, Col. 4, lines 26–30). The fastening assembly includes ridges 425 on the outer surfaces of the fastening strips 414 and 415, and shoulders 421*b* and 422*b* on the side walls of the slider. (U.S. Pat. No. 5,664,299, Col. 4, lines 62–65). The shoulders act as means for maintaining the slider in straddling relation with the fastening strips by grasping the lower surfaces of the ridges 425. (U.S. Pat. No. 5,664,299, Col. 5, lines 4–7).

Also, the interlocking fastening strips may be "rolling action" fastening strips as shown in FIG. 11 and described in U.S. Pat. No. 5,007,143. The strips 514 and 515 include profiled tracks 518 and 519 extending along the length thereof parallel to the rib and groove elements 516 and 517 and the rib and groove elements 516, 517 have complimentary cross-sectional shapes such that they are closed by pressing the bottom of the elements together first and then rolling the elements to a closed position toward the top thereof. (U.S. Pat. No. 5,007,143, Col. 4, line 62 to Col. 5, line 1). The rib element 516 is hook shaped and projects from the inner face of strip 514. (U.S. Pat. No. 5,007,143, Col. 5, lines 1–3). The groove element 517 includes a lower hook-shaped projection 517*a* and a relatively straight projection 517*b* which extend from the inner face of strip 515. (U.S. Pat. No. 5,007,143, Col. 5, lines 3–6). The profiled tracks 518 and 519 are inclined inwardly toward each other from their respective strips 514 and 515. (U.S. Pat. No. 5,007,143, Col. 5, lines 6–8).

The straddling slider 510 comprises an inverted U-shaped plastic member having a back 520 for moving along the top edges of the tracks 518 and 519 with side walls 521 and 522 depending therefrom for cooperating with the tracks and extending from an opening end of the slider to a closing end. (U.S. Pat. No. 5,007,143, Col. 5, lines 26–31). A separator finger 523 depends from the back 520 between the side walls 521 and 522 and is inserted between the inclined tracks 518 and 519. (U.S. Pat. No. 5,007,143, Col. 5, lines 34–36). The slider 510 has shoulders 521*a* and 522*a* projecting inwardly from the depending side walls 521 and 522 which are shaped throughout the length thereof for cooperation with the depending separator finger 523 in creating the rolling action in opening and closing the reclosable interlocking rib and groove profile elements 516 and 517. (U.S. Pat. No. 5,007,143, Col. 5, lines 43–49).

The interlocking fastening strips may be manufactured by extrusion through a die and may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. The bag may be made from a mixture of high pressure, low density polyethylene and linear, low density polyethylene.

The fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the fastening strips or expected additional manufacturing operations. The slits may be cut during the manufacturing of the fastening strips using rollers which contain an appropriately placed knife edge.

Generally, the fastening strips can be manufactured in a variety of forms to suit the intended use. The fastening strips may be integrally formed on the opposing sidewalls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding may be done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene).

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. In addition, all references and copending applications cited herein are hereby incorporated by reference in their entireties.

What is claimed is:

1. A closure device, comprising:

first and second fastening strips, the fastening strips have a longitudinal X axis, a transverse Y axis and a vertical Z axis, the fastening strips are arranged to be interlocked over a predetermined length in the X axis, the fastening strips being secured together at first and second ends;

a slider slidably disposed on the fastening strips for movement between the first and second ends, the slider including a separator facilitating the deocclusion of the fastening strips when the slider is moved towards the second end; and a first slit located on the first fastening strip near the first end, the first slit at an angle to the X axis.

2. The invention as in claim 1 wherein the angle is between 1° and 179° from the X axis.

3. The invention as in claim 2 wherein the angle is at 90° to the X axis.

4. The invention as in claim 2 wherein the angle is between 45° and 135° from the X axis.

5. The invention as in claim 1 wherein a second slit is located on the second fastening strip near the first end.

6. The invention as in claim 5 wherein the angle is between 1° and 179° from the X axis.

7. The invention as in claim 6 wherein the angle is at 90° to the X axis.

8. The invention as in claim 6 wherein the angle is between 45° and 135° from the X axis.

9. The invention as in claim 1 wherein the first and second fastening strips include a plurality of slits near the first end.

10. The invention as in claim 1 wherein the first slit is located between the first end and the separator.

11. The invention as in claim 5 wherein the second slit is located between the first end and the separator.

12. The invention as in claim 1 wherein the second fastening strip includes a second slit near the first end, the first fastening strip includes a third slit near the first end, the second fastening strip includes a fourth slit near the first end.

13. The invention as in claim 12 wherein the separator is located between the first slit and the third slit when the separator is near the first end.

14. The invention as in claim 13 wherein the separator is located between the second slit and the fourth slit when the separator is near the first end.

15. The invention as in claim 1 wherein the first fastening strip includes a first closure element and the first slit is located above the first closure element.

16. The invention as in claim 1 wherein the first fastening strip includes a first closure element, the first closure element includes a first web and a second web, the second fastening strip includes a second closure element, the second closure element includes a third web and a fourth web.

17. A container comprising:

first and second sidewalls including first and second fastening strips respectively, the fastening strips have a longitudinal X axis, a transverse Y axis and a vertical Z axis, the fastening strips are arranged to be interlocked over a predetermined length in the X axis, the fastening strips being secured together at first and second ends;

a slider slidably disposed on the fastening strips for movement between the first and second ends, the slider including a separator facilitating the deocclusion of the fastening strips when the slider is moved towards the second end; and a first slit located on the first fastening strip near the first end, the first slit at an angle to the X axis.

18. The invention as in claim 17 wherein the angle is between 1° and 179° from the X axis.

19. The invention as in claim 18 wherein the angle is at 90° to the X axis.

20. The invention as in claim 18 wherein the angle is between 45° and 135° from the X axis.

21. The invention as in claim 17 wherein a second slit is located on the second fastening strip near the first end.

22. The invention as in claim 21 wherein the angle is between 1° and 179° from the X axis.

23. The invention as in claim 22 wherein the angle is at 90° to the X axis.

24. The invention as in claim 22 wherein the angle is between 45° and 135° from the X axis.

25. The invention as in claim 17 wherein the first and second fastening strips include a plurality of slits near the first end.

26. The invention as in claim 17 wherein the first slit is located between the first end and the separator.

27. The invention as in claim 21 wherein the second slit is located between the first end and the separator.

28. The invention as in claim 17 wherein the second fastening strip includes a second slit near the first end, the first fastening strip includes a third slit near the first end, the second fastening strip includes a fourth slit near the first end.

29. The invention as in claim 28 wherein the separator is located between the first slit and the third slit when the separator is near the first end.

30. The invention as in claim 29 wherein the separator is located between the second slit and the fourth slit when the separator is near the first end.

31. The invention as in claim 17 wherein the first fastening strip includes a first closure element and the first slit is located above the first closure element.

32. The invention as in claim 17 wherein the first fastening strip includes a first closure element, the first closure element includes a first web and a second web, the second fastening strip includes a second closure element, the second closure element includes a third web and a fourth web.

33. A method of manufacturing a closure device, comprising:

providing first and second fastening strips, the fastening strips have a longitudinal X axis, a transverse Y axis and a vertical Z axis, the fastening strips are arranged to be interlocked over a predetermined length in the X axis, the fastening strips being secured together at first and second ends;

providing a slider slidably disposed on the fastening strips for movement between the first and second ends, the slider including a separator facilitating the deocclusion of the fastening strips when the slider is moved towards the second end; and providing a first slit located on the first fastening strip near the first end, the first slit at an angle to the X axis.

34. The invention as in claim 33 wherein the angle is between 1° and 179° from the X axis.

35. The invention as in claim 34 wherein the angle is at 90° to the X axis.

36. The invention as in claim 34 wherein the angle is between 45° and 135° from the X axis.

37. The invention as in claim 33 wherein a second slit is located on the second fastening strip near the first end.

38. The invention as in claim 37 wherein the angle is between 1° and 179° from the X axis.

39. The invention as in claim 38 wherein the angle is at 90° to the X axis.

40. The invention as in claim 38 wherein the angle is between 45° and 135° from the X axis.

41. The invention as in claim 33 wherein the first and second fastening strips include a plurality of slits near the first end.

42. The invention as in claim 33 wherein the first slit is located between the first end and the separator.

43. The invention as in claim 37 wherein the second slit is located between the first end and the separator.

44. The invention as in claim 33 wherein the second fastening strip includes a second slit near the first end, the first fastening strip includes a third slit near the first end, the second fastening strip includes a fourth slit near the first end.

45. The invention as in claim 44 wherein the separator is located between the first slit and the third slit when the separator is near the first end.

46. The invention as in claim 45 wherein the separator is located between the second slit and the fourth slit when the separator is near the first end.

47. The invention as in claim 33 wherein the first fastening strip includes a first closure element and the first slit is located above the first closure element.

48. The invention as in claim 33 wherein the first fastening strip includes a first closure element, the first closure element includes a first web and a second web, the second fastening strip includes a second closure element, the second closure element includes a third web and a fourth web.

* * * * *